United States Patent [19]

Beaulieu et al.

[11] Patent Number: 4,516,363

[45] Date of Patent: May 14, 1985

[54] SUPERINSULATION ROOF RAFTER TRUSSES AND BUILDING SYSTEM

[75] Inventors: Roger D. Beaulieu, Standish; William W. Alcorn, Cape Elizabeth; David S. Matychowiak, Saco, all of Me.

[73] Assignee: Super-Truss Building Systems, Inc., Gorham, Me.

[21] Appl. No.: 487,693

[22] Filed: Apr. 22, 1983

[51] Int. Cl.[3] ..... E04B 7/00

[52] U.S. Cl. ..... 52/90; 52/198; 52/404

[58] Field of Search ..... 52/90, 94, 404, 743, 52/198, 199, 639, 643, 22

[56] References Cited

U.S. PATENT DOCUMENTS

| | | | |
|---|---|---|---|
| 4,007,672 | 2/1977 | Luckey | 52/90 |
| 4,030,256 | 6/1977 | Ollman | 52/90 |
| 4,185,433 | 1/1980 | Cantrell | 52/404 |

FOREIGN PATENT DOCUMENTS

| | | | |
|---|---|---|---|
| 2519602 | 11/1976 | Fed. Rep. of Germany | 52/90 |
| 2041060 | 9/1980 | United Kingdom | 52/90 |

*Primary Examiner*—J. Karl Bell

*Attorney, Agent, or Firm*—Daniel H. Kane, Jr.

[57] ABSTRACT

Prefabricated roof rafter truss structures are provided which function as deep webbing rafters for spanning and enclosing a living space and accommodating superinsulation. In each truss structure first and second outer rafter chords define a roof gable. At least one inner rafter chord is rigidly joined in parallel relationship to an outer rafter chord by deep webbing to define a rafter depth sufficient to accommodate insulation with an R factor of 60 or greater with ventilation space over the insulation. The truss structure also includes a horizontal ceiling joist chord positioned above and joined to the upper end of the inner rafter chord. Further deep webbing rigidly joins and spaces the horizontal ceiling joist chord with reference to the first and second outer rafter chords and generally ties the truss webs and chords into a rigid structure including the extending deep rafter portions. The attic space over the ceiling joist chord is also sufficient to accommodate superinsulation. The prefabricated truss structures are of flexible configuration and may be arranged for a variety of roof styles in which the rafter portions also function as the ceiling including, for example, capes, saltboxes, dormers, hips, gambrel roofs, and other high ceiling designs. The various truss structures are incorporated into a superinsulation building system in which deep insulation is retained between the inner and outer surface coverings secured to a set of truss structures. Air ventilation passageways are defined over the insulation by porous or air breathing material leading from the soffet cavity to the attic space and ridge vent.

21 Claims, 7 Drawing Figures

SUPERINSULATION ROOF RAFTER TRUSSES AND BUILDING SYSTEM

TECHNICAL FIELD

This invention relates to new prefabricated roof trusses for enclosing a space and for accommodating insulation to superinsulating depths. The invention also relates to a new superinsulation building system incorporating the trusses.

BACKGROUND ART

Concern over energy utilization has resulted in the use of increasing amounts of insulation and higher R factors in building construction. Insulation of building walls to an R value of 35 and greater and insulation of roofs to an R value of 60 and greater is referred to as "superinsulation". A variety of building methods have been employed successfully for superinsulation of building walls. Similarly, in roofs with full attics superinsulation is commonly achieved by depositing, for example, fiberglass insulation to depths of 18 to 20 inches or more for achieving R factors of 70 and greater.

Superinsulation in the roof is difficult to achieve, however, for types of house and building construction which do not provide full attics in the roof. For example, cape style homes, saltboxes, roof dormers, hip roofs, gambrel, and cathedral ceiling designs may afford attic space only over a fraction of the roof area or no attic space at all. It is difficult and expensive to achieve superinsulation R values of 60 and greater in roofs of this type. The problem common to these types of roof construction is that the roof rafter is also the ceiling rafter thereby limiting the amount and depth of insulation to the size and depth of the rafter beam which in turn limits the depth of the rafter cavity.

The most frequently used method to achieve high R values in this type of roof construction is to use 2"×12" rafters. Ten inches of fiberglass insulation is placed or blown in between the rafters with two inches of polyisocyanurate insulation on the inside face of the rafters. This is an expensive building technique which also presents problems with sheetrocking over the insulation board and placement of electrical fixtures. Furthermore, the insulation R factor falls short of superinsulation, for example R-48, and even this level of R value occurs inconsistently. Areas of higher heat conduction remain, caused by solid wood rafters which extend through the rafter cavity and increase the conduction losses. This conventional construction also results in "over building" with excessive volume of wood and excessive weight.

While the use of prefabricated roof trusses, for example, as described in U.S. Pat. No. 2,840,014, is well known in building construction, such prefabricated trusses suffer similar limitations in applications requiring increased insulation. Basically, only those prefabricated trusses providing a full attic space lend themselves to depositing or blowing in insulation to superinsulating depths. In applications, for example, to construction of capes, saltboxes, gambrel roofs, etc., prefabricated trusses do not lend themselves to enclosing and defining a high ceiling living space according to the desired style while at the same time accommodating depths of insulation for achieving very high R values. A typical handbook of truss configurations is found, for example, in the handbook *Truss Shapes,* "A Numerical System for Describing Truss Configurations", Technical Bulletin No. 2, Hydro-Air Engineering, Inc., 700 Office Parkway, Creve Coeur, Mo. 63141. Such conventional prefabricated roof trusses generally define an attic over a living space rather than enclosing the living space itself.

OBJECTS OF THE INVENTION

It is therefore an object of the present invention to provide a new and improved superinsulation building system for roof styles in which the roof rafter is also the ceiling rafter but which is capable of accommodating insulation to a depth for superinsulation at an R factor of 60 or greater and with additional ventilation space over the insulation.

Another object of the invention is to provide a variety of new and improved prefabricated roof rafter trusses for building superinsulated capes, dormers, saltboxes, gambrels, hips, and cathedral ceiling roof designs.

A further object of the invention is to provide new and improved prefabricated roof rafter trusses in which portions of the trusses function as deep rafters for enclosing a living space according to the desired roof style while still accommodating depths of insulation to superinsulating R factors. According to this object of the invention, the quantity and weight of wood and the continuous solid wood through the depth of the rafter required by conventional roofing construction is avoided. Thus, the invention provides a lightweight and economical building system applicable for a variety of roofing styles, which is flexible, and which lends itself conveniently to prefabrication and rapid installation.

DISCLOSURE OF THE INVENTION

In order to accomplish these results the present invention provides a new roof rafter truss structure which actually functions as a deep rafter for enclosing a living space. In its essential elements the new roof rafter truss structure comprises first and second outer rafter chords defining a roof gable with respective sloping sides leading from gable eaves to a gable ridge. A first inner rafter chord is positioned parallel to and spaced from at least a portion of the first outer rafter chord. A first deep webbing comprising a first set of webs rigidly joins the first outer and inner rafter chords in parallel, spaced apart a sufficient distance to accommodate a depth of insulation for superinsulation with R factor of 60 or greater and with ventilation space over the insulation. The first inner and outer rafter chords thereby function as a deep rafter portion of the truss structure for enclosing a living space and defining both the roof and ceiling. A feature and advantage of this truss structure is that the first outer and inner rafter chords define a first superinsulation channel with ample depth for ventilation space above from the gable eave to the gable ridge.

The truss structure invention also provides a horizontal ceiling joist chord positioned above and joined to the upper end of the first inner rafter chord. A second deep webbing comprising a second set of webs rigidly joins and spaces the horizontal ceiling joist chord to the first and second outer rafter chords rigidly tying the chords of the truss structure together. The outer rafter chords and the ceiling joist chord define an attic space sufficient to accommodate a depth of insulation for superinsulation at an R factor of 60 or greater with ridge space ventilation above. A feature and advantage of this truss structure arrangement is that the attic space communicates with the superinsulation channel or deep webbing rafter portion of the truss structure. Furthermore, the ceiling joist chord and deep webbing tie the sloping sides of the roof gable together while the ceiling joist chord and inner rafter chord partially define an inner living space below the roof rafter truss structure.

The prefabricated truss construction according to the present invention affords flexibility for a variety of roofing styles. According to one embodiment a second inner rafter chord is provided along with third deep webbing comprising a third set of webs rigidly joining the second inner rafter chord to the second outer rafter chord in parallel and spaced apart a sufficient distance to accommodate superinsulation with R factor of 60 or greater and with ample depth for ventilation space over the insulation from gable eave to gable ridge. The second outer and inner rafter chords define a second superinsulation channel and second rafter portion of the truss structure sloping away from the first rafter portion and first superinsulation channel to complete the gable, for example, for a cape style roof.

A feature and advantage of the flexible truss structure according to the invention is that the superinsulation channel deep rafter portions of the prefabricated trusses may be arranged in a variety of configurations for cape, saltbox, dormer, gambrel and other high ceiling roof construction designs. The different roof rafter truss structures may also be combined in desired sequences, for example, to incorporate superinsulated dormer spaces in a superinsulated cape roof without loss of continuity of the superinsulation R values. The deep webbing may be arranged in either the Howe truss configuration or W truss configuration best suited to tie the particular arrangement of the chords and to achieve the desired load bearing strength.

The invention also contemplates providing a superinsulation building system incorporating a plurality of the improved and prefabricated roof rafter truss structures arranged in adjacent spaced apart parallel configuration. The deep webbing rafter portions of the truss structures thereby define and bound a plurality of first superinsulation channels on one side of the gable between the respective inner and outer rafter chords and also between each pair of the roof rafter truss structures. The adjacent truss structures also define an extended attic space between the ceiling joist chords and the outer rafter chords with the attic space communicating with the superinsulation channels. The inner wall or skin of the building is secured below the first inner rafter chords and horizontal ceiling joist chords and supports, for example, blown-in insulation to depths of 18 to 20 inches (46 to 50 cm) for superinsulation R values of 60 to 70 and greater. The outer roofing surface or skin is secured over the outer rafter chords.

According to the invention a permeable air breathing material is secured between adjacent outer rafter chords and to the outer roof surface for defining an air breathing upper boundary for the superinsulation channels and assuring a ventilating space above between the air breathing permeable material and the outer roof surface. The air breathing material is configured to assure a ventilating passageway space, channel or cavity running from the gable eaves to the attic space and through the attic space to the gable ridge of the roof gable for ventilation and breathing of insulation retained in the superinsulation channels. Thus, blown-in insulation is retained by the boundaries of the superinsulation channels and rests in the attic space without passing through the vent boundary material or passing into the ventilating space. In a further feature of the invention a soffet structure is provided along the gable eaves for defining a soffet cavity communicating with the ventilating space over the insulation and with a ventilation opening to the outside. The soffet structure also includes a baffle for retaining the superinsulation at the gable eave ends and preventing the insulation from entering the soffet cavity or ventilating spaces.

Other objects, features and advantages of the invention will become apparent in the following specification and accompanying claims.

DESCRIPTION OF PREFERRED EXAMPLE EMBODIMENTS AND BEST MODE OF THE INVENTION

Figure 1:
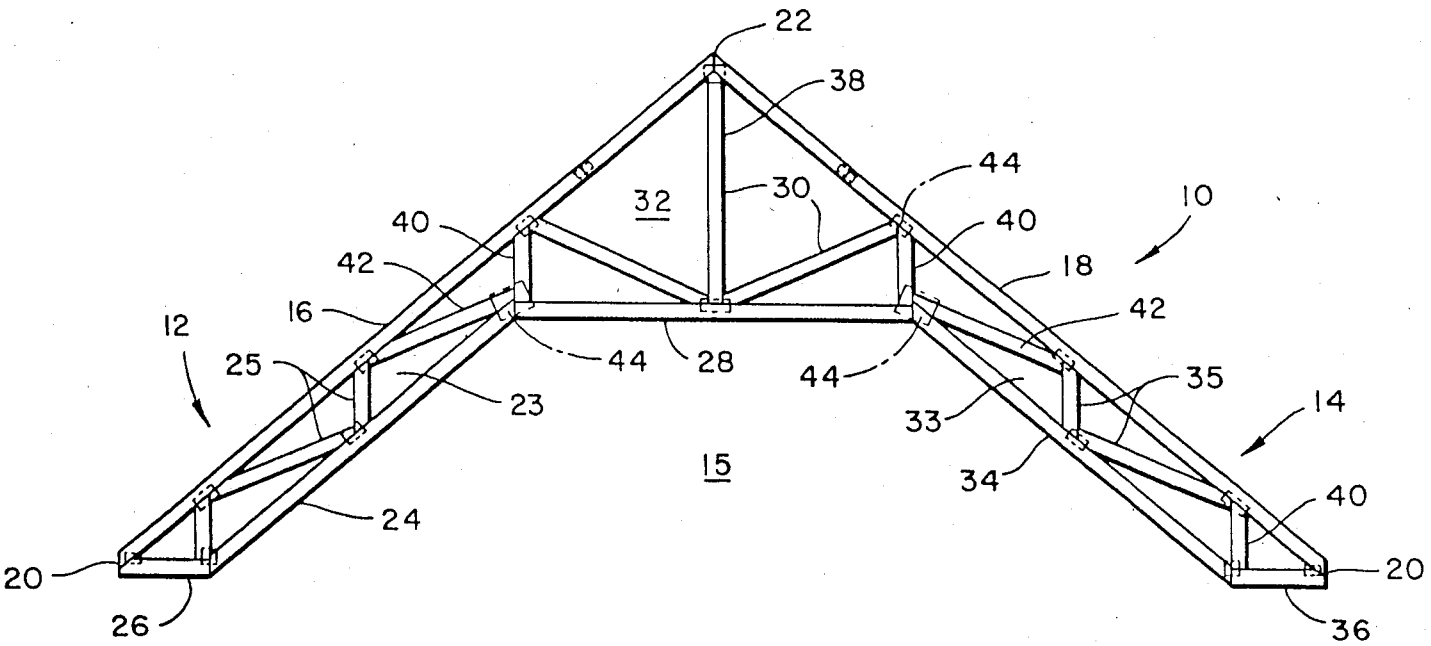
FIG. 1 is a side elevation of a superinsulating roof rafter truss according to the invention suitable for a cape style roof.

A prefabricated roof rafter truss 10 suitable for use in a cape style roof superinsulation building system according to the invention is illustrated in FIG. 1. The cape style truss 10 is constructed with deep webbing rafter portions 12 and 14 which define the sloping sides of the cape roof gable and enclose an define an inner living space 15 within and below the truss. Each truss is formed with first and second outer rafter chords 16 and 18 leading from the gable eaves 20 of the sloping sides to the gable ridge 22 of the roof gable. A first inner rafter chord 24 is aligned in parallel with a portion of the first outer chord 16 and rigidly joined by a first deep webbing or first set of webs 25. The phrase "deep webbing" is used herein to mean a set of webs of selected length which rigidly join but space apart the inner and outer chords a sufficient distance to accommodate a depth of insulation for superinsulation with R factor of 60 or greater and with ventilation space over the insulation. Thus, the spacing between the first outer and inner rafter chords 16 and 24 of the truss 10 must be sufficient to accommodate 18 to 20 inches (46 to 51 cm) of insulation with ventilation space above. This is typically accomplished by spacing the inner and outer chords from each other a perpendicular or orthogonal distance of, for example, two feet (61 cm). The lower base chord 26 serves further to define the parallel spacing of the inner and outer rafter chords and functions both as a perimeter chord and as a continuation of the first deep webbing 25.

The horizontal ceiling joist chord 28 forms another essential element of the truss construction and is positioned above and joined to the upper end of the first inner rafter chord 24. A second deep webbing 30 comprising a second set of webs rigidly joins and spaces the horizontal ceiling joist chord 28 with reference to the first and second outer rafter chords 16 and 18. The outer rafter chords 16 and 18 and ceiling joist chord 28 define an attic space 32 sufficient to accommodate the depth of insulation for superinsulation at an R factor of 60 or greater with ridge space ventilation above. The attic space 32 communicates with the first superinsulation channel 23 defined by the first outer and inner rafter chords 16 and 24. The superinsulation channel 23 and attic space 32 thereby provide ventilation space from the gable eave 20 to the gable ridge 22.

In the example of FIG. 1 there is also provided a second inner rafter chord 34 and third deep webbing 35 rigidly joining the second inner rafter chord 34 to the second outer rafter chord 18 in parallel. The second inner and outer rafter chords are spaced apart a sufficient distance to accommodate insulation to a superinsulation depth with R factor of 60 or greater and with ventilation space over the insulation from gable eave to gable ridge. Thus, the second inner and outer rafter chords 34 and 18 are typically spaced from each other a perpendicular or orthogonal distance of two feet (61 cm) by the third set of webs 35 and the base chord 36 which may be viewed as either a perimeter chord or a portion of the deep webbing 35. The second inner and outer rafter chords 34 and 18 define a second superinsulation channel 33 which also communicates with the attic space 32 and in combination with the attic space affords ventilation space from the gable eave 20 to the gable ridge 22.

It is apparent that the placement of the webs 25, 30, and 35 within the outer perimeter chords of the truss structure is in accordance with a Howe truss configuration with a central king post 38 and successive spaced apart vertical web posts 40 joined and triangulated by diagonal webs 42. The spacing of the vertical posts 40 in the Howe truss webbing along with other parameters of the truss is a function of load bearing requirements and is readily calculated according to conventional methods. The webs and chords are rigidly secured to each other at the mating scarf cuts by conventional truss plates 44 shown in phantom in FIG. 1 and subsequent Figures.

It is apparent that the horizontal ceiling joist chord 28 and second deep webbing 30 tie the sloping sides 12 and 14 of the cape roof gable together affording an unobstructed span from gable eave to gable eave defining an ample living space 15 within and below the roof rafter portions and ceiling joist portion of the truss. In other words, as shown in the drawings, the horizontal ceiling joist and inner rafter chords are integral parts of the perimeter of the roof truss and define a raised ceiling living space below the roof truss that is recessed within the roof gable. The unitary integral structure of the roof truss from eave to eave provides a clear span without obstruction over the raised ceiling or high ceiling living space below. The novel truss structure in accordance with the present invention cannot be viewed as two floor trusses with a collar tie, but rather is an integral truss with a flat central bottom chord which functions to tie the sloping deep rafter legs of the truss for maximum span and spacial enclosure. There is no continuous horizontal flat bottom chord from eave to eave, nor are interior bearing walls required. Rather the roof rafter truss structure according to the present invention is a full living space defining truss with well defined superinsulation channels in deep webbing rafter legs communicating with a central attic space. The horizontal ceiling joist and further deep webbing tie the entire truss structure together into a rigid unit.

Figure 2:
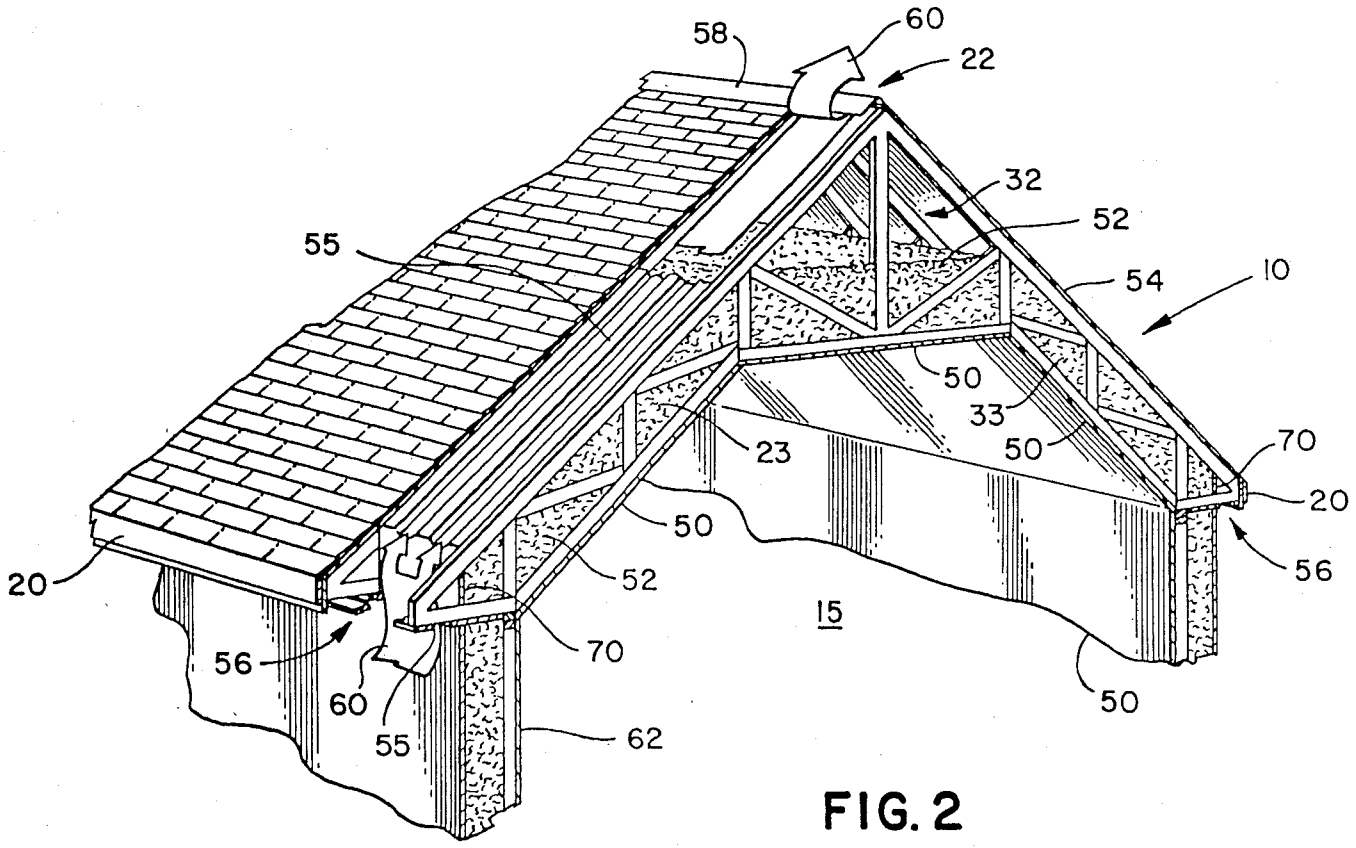
FIG. 2 is a fragmentary perspective view of a cape roof and structure partially cut away showing the superinsulation building system according to the present invention.

The superinsulation building system according to the present invention incorporating the roof rafter truss structures of the type described with reference to FIG. 1 is illustrated in FIG. 2. A plurality of roof rafter truss structures 10 are arranged in adjacent spaced apart and parallel configuration for defining and bounding a plurality of first and second superinsulation channels 23 and 33, not only between the respective inner and outer rafter chords of each truss, but also between each pair of the roof rafter truss structures. An extended attic space 32 is also defined along the length of the cape roof gable communicating with the superinsulation deep rafter channels. An inner wall covering or skin is secured below the inner rafter chords and horizontal ceiling joist chords to define the surface of the living space 15 below the plurality of truss structures. The inner surface covering material 50 which may be, for example, sheetrock or wallboard, defines the lower boundary of the attic space 32 and the superinsulation channels 23 and 33 and supports the insulation 52 which is typically blown-in fiberglass insulation deposited and accumulated to a depth of 18 to 20 inches.

The outer roof surface or skin 54, such as, for example, plywood sheathing, is secured over the outer rafter chords of the truss structures. In order to prevent the blown-in insulation 52 from completely filling the superinsulation channels 23 and 33 from the inner surface skin 50 to the outer surface 54, thereby eliminating the ventilating space, the following steps are taken according to the present superinsulation building system. A series of parallel vents or ventilating passageways spaces, channels or cavities are defined between the outer rafter chords at the top of the superinsulation channels between the insulation 52 and the roof sheathing 54. The ventilating spaces 55 are defined by permeable air breathing material shaped to a preserve parallel passageways from the gable eaves 20 to the attic space 32 and gable ridge 22. The ventilating channels or spaces 55 need only extend from the eaves to the attic space 32 where the attic air communicates with the outside through the ridge vent 58. As hereafter described in further detail with reference to FIG. 2A, a soffet construction 56 may be provided at the gable eave with ventilation for entry of ventilating air 60 which passes through the ventilating passageways spaces 55 to the attic space 32 and through the ridge vent 58. The air breathing permeable material which defines the ventilating spaces 55 may be, for example, a rigid perforated or porous plastic, molded or extruded in the configuration to preserve the air passageways over the insulation. The material permits aeration of the insulation 52 while preventing passage of insulation 52 into the ventilating space. Typically the ventilation boundary defining material is configured to preserve at least 2 inches (5 cm) of air ventilating space over the insulation.

Figure 2A:
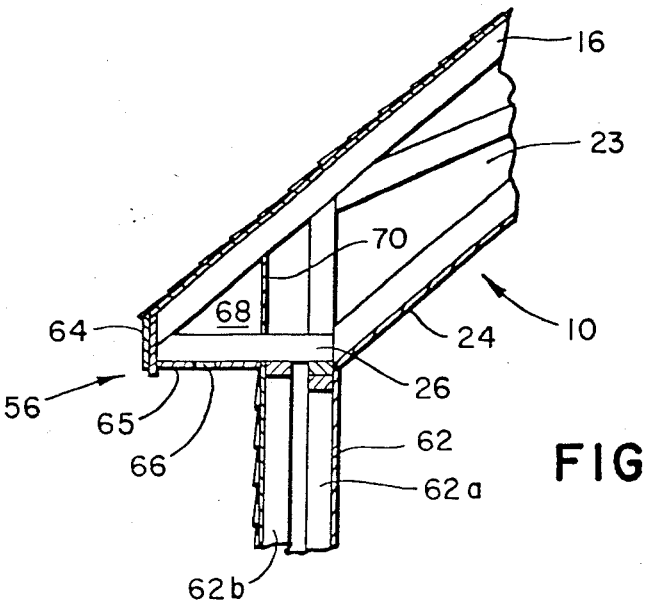
FIG. 2A is a detailed section view of the soffet construction at one side of the cape roof.

Details of a soffet construction 56 for the superinsulation building system of FIG. 2 is shown in FIG. 2A. The base chord 26 of truss structure 10 rests on the top of the building wall 62 which in this case is formed by an inner stud wall 62A and an outer stud wall 62B which permit wall insulation thicknesses for superinsulation R values in the wall. The eave ends of the trusses 10 are plum cut and covered with fascia material 64. The base chords or bottom chords 26 of successive trusses 10 are covered with finishing material 65 through which vents 66 are formed for ventilation of the soffet cavity 68. The soffet cavity 68 is bounded by an insulation baffle 70 which holds back insulation blown into the channel 23 to prevent insulation from entering the soffet cavity. The soffet cavity 68 in turn communicates with the air ventilation spaces 65 formed over the insulation and leading to the attic space 32 and ridge vent 58. Thus, the superinsulation building system according to the invention affords continuous air ventilation from the gable eaves to the gable ridge while accommodating blown-in fiberglass insulation to depths of 18 to 20 inches (46 to 51 cm).

Figure 3:
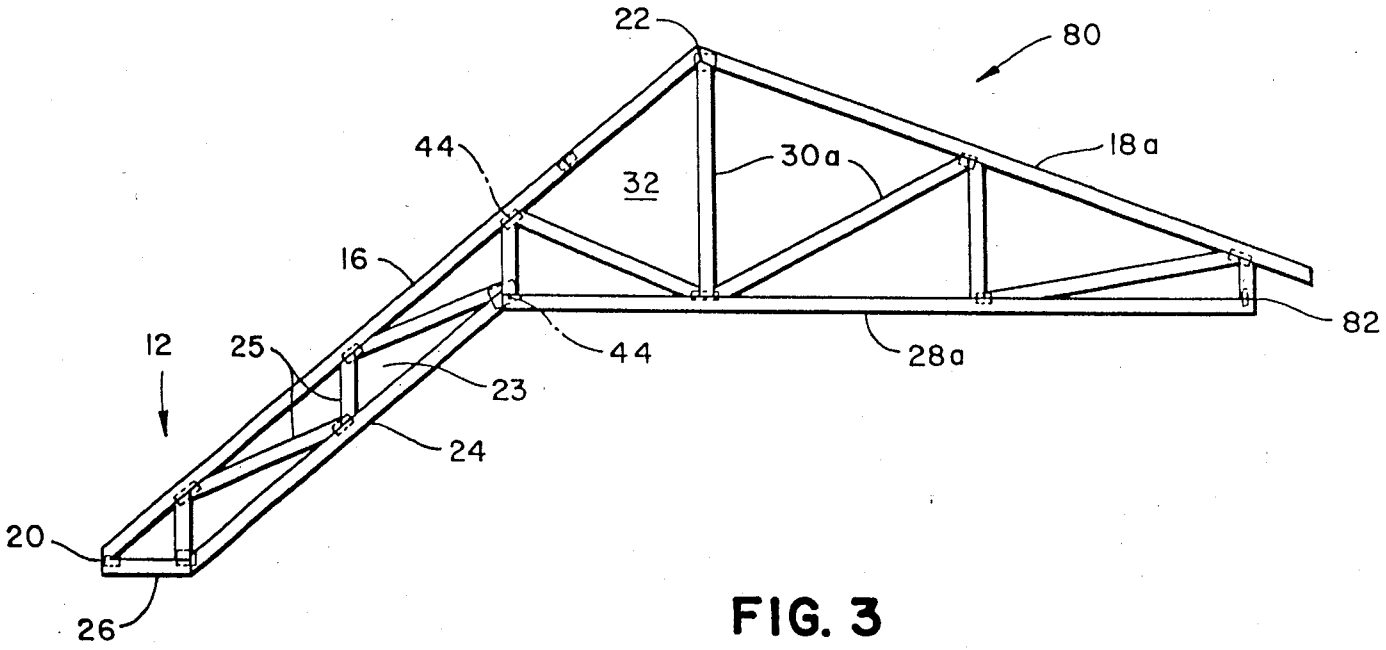
FIG. 3 is a side elevation of a superinsulating dormer roof rafter truss suitable for use in combination, for example, with the cape roof of FIG. 2.

A dormer roof rafter truss 80, useful for adding dormers to the superinsulation building system of FIG. 2 is illustrated in FIG. 3. The truss configuration 80 is particularly applicable for adding dormers to a cape roof gable formed by the cape roof rafter trusses 10 of the FIG. 1. The left half of the dormer roof rafter truss structure 80 of FIG. 3 is identical with the left half of the cape roof rafter truss structure of FIG. 1 and the corresponding elements are similarly numbered. Thus, the left half of the dormer truss 80 includes a sloping deep rafter portion 12 as heretofore described defining a superinsulation channel 23 leading to the attic space 32. The right half of dormer truss 80, however, differs and is designed for incorporating superinsulated dormers into the cape roof gable. Thus, the dormer gable is a dual pitch gable with outer rafter chord 18A at a lesser slope than outer rafter chord 16. Furthermore, the inner horizontal ceiling joist 28A is extended to the right effectively to join the outer rafter chord 18A directly or through a short outer chord 82 which may be viewed also as part of the deep webbing 30A joining the ceiling joist chord 28A to the outer rafter chords 16 and 18A. In effect, the attic space 32 defined by the ceiling joist chord and outer rafter chords is extended to the right of the truss structure, but at all places is sufficient to accommodate insulation to a depth sufficient for superinsulation R factors over the dormer space. The appearance of the projecting dormer within the cape gable roof may be seen by superimposing FIG. 3 over FIG. 1. Such a dormer is incorporated into the cape roof gable by substituting a number of the dormer trusses 80 for the cape trusses 10 at the desired location and for the desired width along the cape roof gable. A feature and advantage of the novel truss structures and superinsulation building system according to the present invention is that superinsulation dormers may be readily incorporated into a superinsulated cape roof with prefabricated structural members while maintaining continuity of superinsulation throughout the length of the roof. The difference of course between the dormer truss 80 of FIG. 3 and the cape roof truss 10 of FIG. 1 is that the dormer truss 80 includes only a single deep rafter portion of sloping spaced apart parallel chords while the cape truss 10 incorporates two deep rafter portions on either side of the gable defined by parallel spaced apart rafter chords. To achieve superinsulation over the dormer space, the dormer truss 80 extends the attic space 32 to the right most extremity of the truss as shown in FIG. 3 for accommodating superinsulation.

It is apparent that the roof rafter truss structure 80 illustrated in FIG. 3 may be useful not only in dormer superinsulation construction, but also in the construction of a dual pitch saltbox in accordance with the superinsulation building system of the present invention. Chords and webs are joined at the scarf cut intersections and joints by truss plates 44 as heretofore described, the size of the truss plate being related to the bearing load of the joint which is readily calculated according to conventional procedures.

Figure 4:
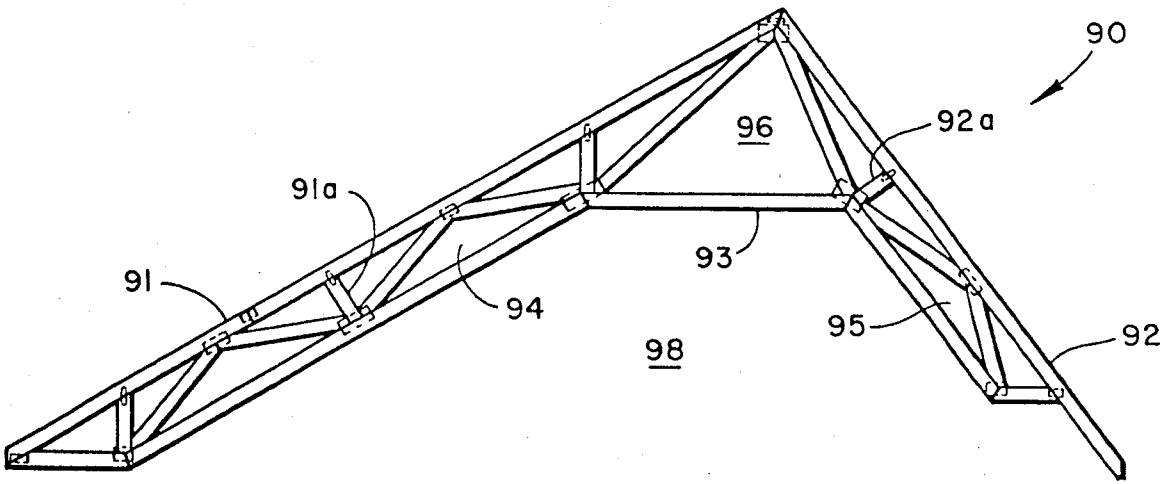
FIG. 4 is a side elevation of a dual pitch superinsulating roof rafter truss according to the present invention applicable for use in a saltbox style roof.

An alternative dual pitch saltbox roof rafter truss structure 90 according to the present invention is illustrated in FIG. 4. In this example the truss structure incorporates first and second deep rafter portions 91 and 92 along the sloping sides of the saltbox gable, each defined by a pair of parallel inner and outer rafter chords rigidly joined by deep webbing as heretofore described. Furthermore, the deep webbing rafter portions 91 and 92 are tied by the horizontal ceiling joist chord 93 and associated deep webbing which ties the inner ceiling joist chord 93 to the outer rafter chords and more generally to the deep webbing rafter portions 91 and 92 to form a unitary rigid truss structure. The chords and webs further define superinsulation channels 94 and 95 and attic space 96, all capable of accommodating depths of fiberglass for superinsulation R values. Each of the sloping deep webbing rafter portions 91 and 92 includes at least one web 91A, 92A, perpendicular to the respective inner and outer rafter chords to establish the desired spacing to accommodate superinsulation with ventilating space over the insulation, all as heretofore described. The saltbox roof rafter truss structures 90 may be incorporated into the building system of the type as illustrated in FIG. 2 but of course adjusted for the saltbox roof. Thus, air ventilation may be provided in constructing the superinsulated saltbox via soffet vents and a soffet cavity to air ventilation spaces or passageways defined by rigid air breathing material above the insulation and superinsulation channels 94 and 95, leading to the attic space 96 and a ridge vent.

Another feature of the construction of the saltbox roof rafter truss 90 of FIG. 4 is that the webbing is arranged in a W or Fink truss webbing configuration rather than the Howe truss webbing configuration shown in FIG. 1 and FIG. 3. Thus, either of the two major web configurations of the conventional truss art may be applied in the novel truss structures of the present invention according to load requirements and other factors in construction and manufacture. A feature and advantage of the saltbox roof rafter struss structure 90 of FIG. 4 similar to that described with reference to the roof rafter truss structure of FIG. 1 is that the truss structure maximizes the unobstructed span as in a conventional truss but unlike the conventional truss, maximizes the living space 98 defined with the bounds of the truss while providing a perimeter structure of sufficient depth to accommodate superinsulation.

Figure 5A:
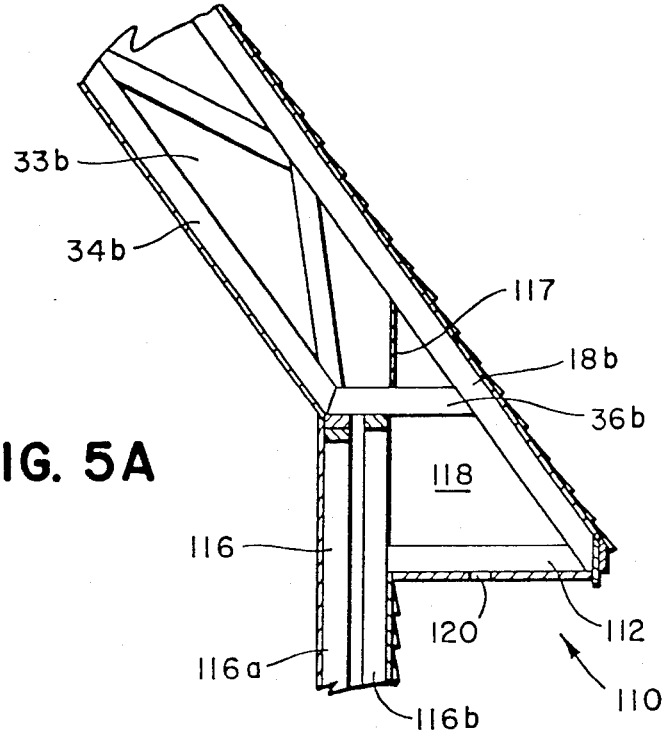
FIG. 5A is a detailed section of an alternative soffet construction on one side of the gambrel roof superinsulation building system.
Figure 5:
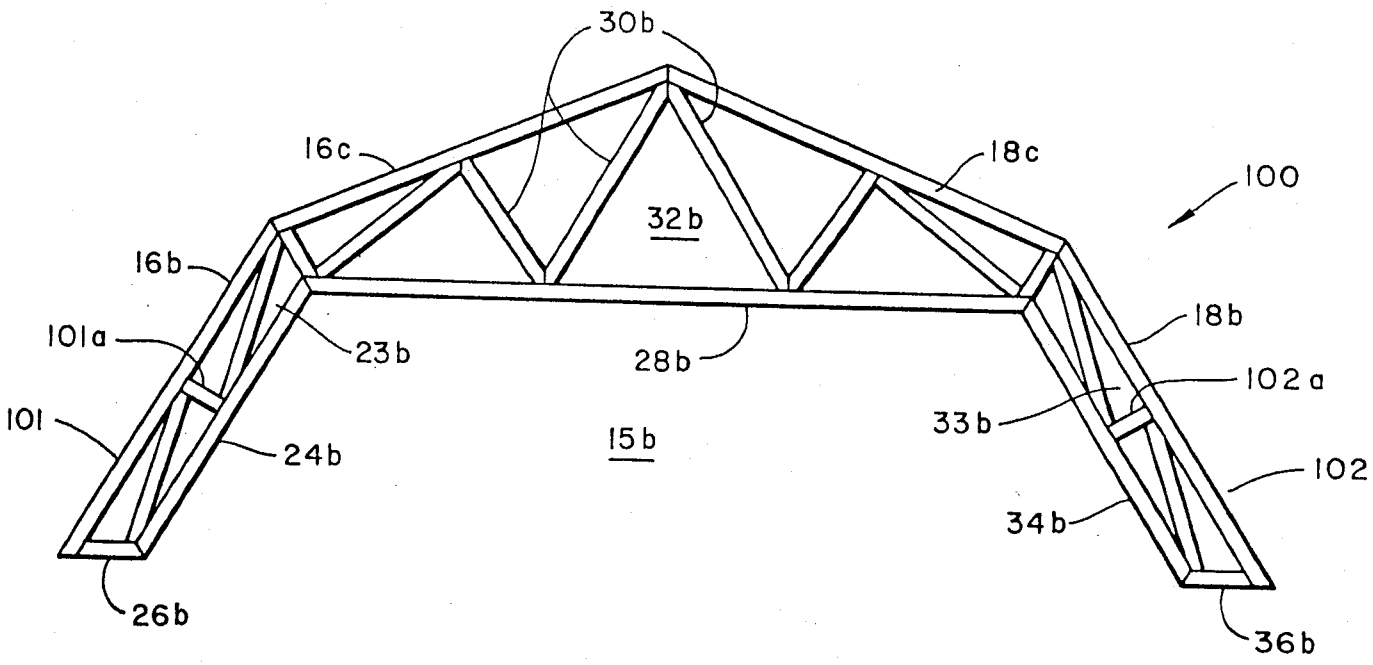
FIG. 5 is a diagrammatic plan view or side elevation of a superinsulating gambrel roof rafter truss according to the present invention.

A gambrel roof rafter truss structure 100 according to the present invention is shown diagrammatically in FIG. 5. The gambrel roof rafter truss may be characterized in a manner similar to the cape roof truss in having first and second sloping and deep webbing rafter portions 101 and 102, each defined by parallel inner and outer rafter chords rigidly joined and spaced apart by deep webbing to accommodate superinsulation. The difference with the cape roof truss structure is that the gambrel roof truss may be viewed as having outer rafter chords 16 and 18, each divided into two segments, 16B and 16C, and 18B and 18C. The outer rafter chord segments 16B and 18B form the deep webbing rafter portions 101 and 102 with inner rafter chord segments 24B and 34B. The deep webbing rafter portions of the gambrel roof are joined by central ceiling joist chord 28B which is in turn tied to the outer rafter chord segments 16C and 18C by the deep webbing 30B. A feature of the gambrel roof rafter truss 100 of FIG. 5 is that the deep webbing is arranged in the W or Fink truss webbing configuration which has the advantage of reducing the angle of the scarf cuts at the ends of the webs in the steeply sloping sides of a gambrel roof. The gambrel truss structure 100 is nevertheless tied together in a unitary truss structure defining superinsulation channels 23B and 33B communicating with attic space 32B and all with depth sufficient to accommodate superinsulation with ventilating space above as heretofore described. Another feature of the deep webbing used in the gambrel roof rafter truss structure of FIG. 5 is found in the deep webbing rafter portions 101 and 102. At least one web, 101A, 102A, respectively, perpendicular to the parallel inner and outer rafter chords is provided to establish and define the spacing of the inner and outer rafter chords. The gambrel roof rafter truss according to the present invention is a unitary rigid structure which achieves an unobstructed span and encloses a high ceiling living space 15B with deep webbing rafter and attic space sufficient to accommodate superinsulation with ventilafion.

A soffet construction detail which may be used, for example, to finish the eaves of the gambrel roof constructed according to the superinsulation building system of FIG. 2 is illustrated in FIG. 5A. According to this soffet finishing construction 110, the outer rafter chord or top chord 18B is extended beyond the bottom chord 34B and "lookouts" 112 are extended back from the outer rafter chord 18B to the building wall 116. The building wall 16 may be constructed of inner stud wall 116A and outer stud wall 116B spaced apart from each other a distance sufficient to accommodate wall insulation thickness with superinsulation R values. The length of top chord or outer rafter chord 18B may be selected to afford the desired length of overhang. The baffle 117 is provided to contain fiberglass insulation blown into the superinsulation channel 33B and to prevent the insulation from entering the soffet cavity 118. Appropriate vents 120 may be formed through the lookouts 112 for air ventilation to the air vent spaces over the superinsulation channels in the manner described in the superinsulation building system of FIG. 2.

In an alternate form for finishing the gambrel roof, the base chord 36B and outer rafter chord 18B may be terminated flush with the outer stud wall 116B of the building wall 116 and an appropriate finishing board or facing board provided in place of the baffle 117. The outer rafter chord 18B may also be extended to provide an overhang beyond the facing board.

It is apparent that the superinsulation building system according to the present invention provides for construction based upon the use of repeated relatively lightweight roof rafter truss structures which minimize the volume and weight of wood necessary to achieve deep rafters. Thus, the relatively lightweight prefabricated construction elements of the present invention may be readily handled and easily assembled. The rigid roof rafter truss structures lend themselves to prefabrication at a manufacturing location for transport to and assembly at the building site. The roof rafter truss structures permit rigid spanning of desired spaces without obstruction and for enclosing and defining living spaces with deep webbing perimeter enclosures which accommodate superinsulation and ventilation.

While the invention has been described with reference to particular example embodiments, it is intended to cover all modifications and equivalents within the scope of the following claims.

We claim:

1. A roof rafter truss structure comprising:

first and second outer rafter chords defining a roof gable from eave to eave with respective first and second sloping sides leading from the gable eaves to a gable ridge;

at least a first inner rafter hord parallel to and spaced from a portion of the first outer rafter chord extending from an eave part way to the gable ridge;

first deep webbing means comprising webs rigidly joining said first outer rafter chord and first inner rafter chord in parallel and spaced apart a sufficient distance to accommodate a depth of insulation for superinsulation with R factor of 60 or greater and with ventilation space over the insulation, said first outer rafter chord and first inner rafter chord defining a first superinsulation channel and ventilation space extending from a gable eave toward the gable ridge;

a horizontal ceiling joist chord positioned above and joined to the upper end of the first inner rafter chord for defining and spanning a living space without obstruction;

second deep webbing means comprising webs rigidly joining and spacing the horizontal ceiling joist chord directly with the first and second outer rafter chords, said webs of the second deep webbing means being coupled to the horizontal ceiling joist chord on one hand, and on the other hand to the first and second outer rafter chords so that the ceiling joist chord is an integral part of the perimeter of the truss structure, said outer rafter chords and ceiling joist chord defining an attic space sufficient to accommodate a depth of insulation for superinsulation at an R factor of 60 or greater with ridge space ventilation above, said attic space communicating with the superinsulation channel;

said ceiling joist chord and deep webbing means tying the sloping first and second outer rafter chords of the roof gable together in a unitary structure, said ceiling joist chord and inner rafter chord partially defining a raised ceiling living space recessed within the roof gable below the roof rafter truss structure;

said outer rafter chords, inner rafter chord, and horizontal ceiling joist chord being tied together directly by said first and second deep webbing means to form a prefabricated integral eave-to-eave roof truss for subsequent incorporation in the roof of a building.

2. The structure of claim 1 further comprising a second inner rafter chord and third deep webbing means comprising webs rigidly joining the second inner rafter chord to the second outer rafter chord in parallel and spaced apart a sufficient distance to accommodate insulation to a depth for superinsulation with R factor of 60 or greater and with ventilation space over the insulation, said second outer rafter chord and second inner rafter chord defining a second superinsulation channel and ventilation space extending from the other gable eave toward the gable ridge.

3. The structure of claim 2 wherein said roof rafter truss structure comprises a cape gable roof rafter truss.

4. The structure of claim 2 wherein said roof rafter truss structure comprises a saltbox gable roof rafter truss.

5. The structure of claim 1 wherein said roof rafter truss structure comprises a dormer roof gable truss.

6. The roof rafter truss structure of claim 2 wherein said second deep webbing means together with the first and third deep webbing means comprise a Howe truss configuration with a center king post at the gable ridge.

7. The structure of claim 2 further comprising third and fourth outer rafter chords positioned between said first and second outer rafter chords and with slopes less than said first and second outer rafter chords thereby defining a gambrel roof rafter truss structure.

8. The structure of claim 7 wherein said second deep webbing means comprises a W or Fink truss configuration.

9. The structure of claim 8 wherein said first and third deep webbing means respectively comprise at least one web perpendicular to the first inner and outer rafter chords and at least one web perpendicular to the second inner and outer rafter chords respectively for defining and maintain the desired spaced apart parallel configuration to define the ventilated superinsulation channels.

10. The structure of claim 1 wherein said second deep webbing means comprises a W or Fink truss configuration.

11. The structure of claim 1 wherein the horizontal ceiling joist chord is tied to the second outer rafter chord at the gable eave end of said chord, thereby defining a dormer roof rafter truss.

12. A superinsulation building system comprising:

a plurality of roof rafter truss structures, each roof rafter truss structure comprising first and second outer rafter chords defining the sloping outer surfaces of a roof gable from gable ridge to gable eaves, at least a first inner rafter chord parallel with and sapced from a portion of the first outer rafter chord, first deep webbing means comprising a plurality of webs rigidly joining the first inner and outer rafter chords in said parallel relationship spaced apart a sufficient distance to accommodate insulation to a depth for superinsulation at an R factor of 60 or greater with ventilation space along the outer rafter chord above said insulation, said first inner and outer rafter chords defining a first superinsulation channel and ventilation space extending from the gable eave toward the gable ridge, a horizontal ceiling joist chord spaced from said first and second outer rafter chords and positioned above and joined to the upper end of the first inner rafter chord for defining and spanning a living space without obstruction, second deep webbing means comprising webs rigidly joining the ceiling joist chord directly with the first and second outer rafter chords, said webs of the second deep webbing means being coupled to the horizontal ceiling joist chord on one hand and on the other hand to the first and second outer rafter chords in a unitary structure so that the ceiling joist chord is an integral part of the perimeter of the truss structure, said ceiling joist chord and outer rafter chords defining an attic space at the gable ridge communicating with said first superinsulation channel, said attic space being sufficient to accommodate insulation to a depth for superinsulation with an R factor of 60 or greater and with a gable ridge ventilation space above the insulation communicating with ventilation space of the first superinsulation channel;

said roof rafter truss structures being prefabricated as integral eave-to-eave roof trusses and then arranged in adjacent spaced apart parallel configuration for defining and bounding a plurality of said first superinsulation channels between the respective inner and outer rafter chords and also between each pair of said plurality of roof rafter truss structures, and for defining an extended attic space between the ceiling joist chords and the outer rafter chords, said attic space communicating with the first superinsulation channels;

inner wall defining means secured below the first inner rafter chords and horizontal ceiling joist chords defining the surface or skin of a raised ceiling living space below the plurality of truss structures and defining the lower boundary of the attic space and first superinsulation channels;

outer roof surface defining means secured over said outer rafter chords;

permeable vent boundary defining means secured between adjacent outer rafter chords and to the outer roof surface defining means, said permeable vent boundary means defining an air breathing upper boundary for said superinsulation channels and further defining with the outer roof surface defining means ventilating spaces above the insulation but impassible to the insulation running from the gable eaves to the attic space and gable ridge of the roof gable for ventilation and breathing of insulation retained in said superinsulation channels;

blown-in insulation retained by the boundaries of the superinsulation channels and resting in said attic space;

and soffet means at the gable eaves of said roof gable comprising baffle means for retaining the insulation at the gable eave ends of the superinsulation channels and vent means communicating with the ventilating space above the superinsulation channels.

13. The building system of claim 12 wherein at least some of said roof truss structures comprises second inner rafter chords and third deep webbing means rigidly joining the second outer and inner rafter chords in parallel spaced apart relationship a distance sufficient to accommodate insulation to a depth for superinsulation with an R factor of 60 or greater and for defining second superinsulation channels and ventilation space extending from the other gable eave toward the gable ridge.

14. The building system of claim 13 wherein said second deep webbing means in combination with said first and third deep webbing means comprise a Howe truss configuration.

15. The building system of claim 13 wherein said rafter roof truss structures comprise a plurality of gable roof rafter trusses intermixed with a plurality of dormer roof rafter trusses thereby providing superinsulated dormer spaces within a superinsulated cape roof.

16. The building system of claim 12 wherein said second deep webbing means in combination with the first deep webbing means comprises a W or Fink truss configuration.

17. The building system of claim 13 wherein said first and second outer rafter chords each comprise first and second chord segments at different sloping angles relative to each other and wherein the roof rafter truss structure is constructed and arranged in the configuration of a gambrel roof rafter truss.

18. The building system of claim 17 wherein the second deep webbing means in combination with the first and third deep webbing means of each said roof rafter truss structure comprises a W or Fink truss configuration.

19. The building system of claim 12 wherein said roof rafter truss structures in combination comprise a superinsulated saltbox roof structure.

20. The building system of claim 13 wherein said roof rafter truss structures in combination comprise a superinsulated cape roof structure.

21. The building system of claim 12 further comprising soffet means constructed and arranged at the gable eave ends of said roof rafter truss structures for defining a soffet cavity at the gable eave ends of said superinsulation channels, said soffet means comprising ventilating opening means communicating through the soffet cavity with the ventilating space defined by the air breathing permeable upper boundary and the outer roof surface defining means of the building system, said soffet means further comprising baffle means for containing blown-in insulation at the gable eave ends of said superinsulation channels and preventing said insulation from entering the soffet cavity.

* * * * *